United States Patent [19]

Rabinow

[11] Patent Number: 4,485,648

[45] Date of Patent: Dec. 4, 1984

[54] KEY LOCK WITH A FLYING SIDEBAR

[76] Inventor: Jacob Rabinow, 6920 Selkirk Dr., Bethesda, Md. 20817

[21] Appl. No.: 424,797

[22] Filed: Sep. 27, 1982

[51] Int. Cl.[3] ..... E05B 29/02; E05B 63/00

[52] U.S. Cl. ..... 70/364 R; 70/419

[58] Field of Search ..... 70/362, 364 R, 364 A, 70/419, 421

[56] References Cited

U.S. PATENT DOCUMENTS

| | | | |
|---|---|---|---|
| 2,023,847 | 12/1935 | Liss | 70/421 |
| 3,172,283 | 3/1965 | Rabinow . | |
| 3,507,133 | 4/1970 | Basseches | 70/421 |
| 3,837,197 | 9/1974 | Lopez | 70/364 A |
| 4,085,601 | 4/1978 | Sauder | 70/364 R |
| 4,111,019 | 9/1978 | Rabinow . | |

*Primary Examiner*—Robert L. Wolfe

*Attorney, Agent, or Firm*—William D. Hall

[57] ABSTRACT

This invention describes a pickproof key lock where the key sets up a series of tumblers each of which has a notch or other configuration that cooperates with a sidebar. This sidebar, when out of engagement with the tumblers, keeps the lock in the inoperative position. The sidebar does not contact the tumblers and is kept in this position normally by the action of two opposing preloaded springs. When a key is inserted into the lock, the internal mechanism is made to operate on the sidebar to move it further away from the tumblers. The mechanism then releases the sidebar and the sidebar is propelled towards the tumblers by the action of a spring. If the tumblers have been properly set, as by a correct key, the sidebar enters the notches in the tumblers and is latched in that position. The lock can then be opened. If any of the tumblers were not set correctly, the sidebar simply impacts against such tumblers and is returned to its normal rest position out of contact with the tumblers. There are no openings for tools or other external means by which the sidebar can be made to press against the tumblers in order to pick the lock. The external mechanism can only move the sidebar away from the locked position and only the inertia of the sidebar after it is triggered enables it either to contact incorrectly set tumblers for a brief instance or to enter all of the tumblers, when correctly set, and be latched in this position.

12 Claims, 16 Drawing Figures

FIG. 1
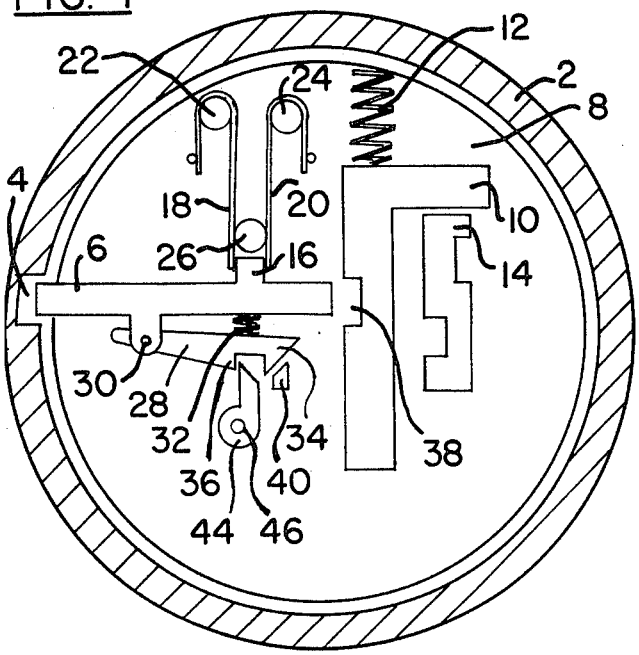
FIG. 2
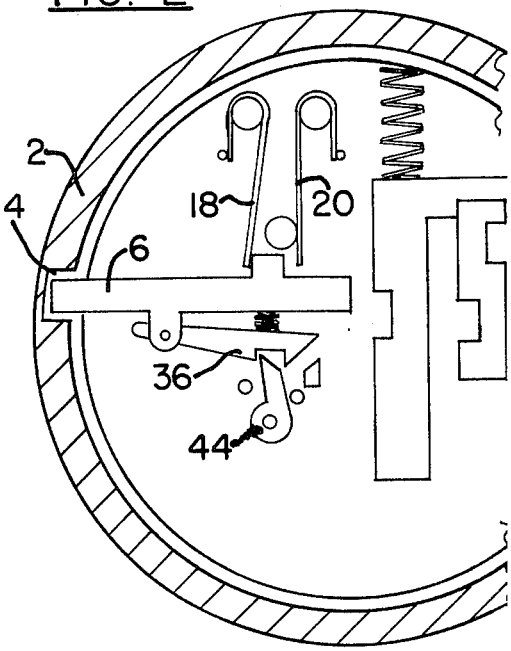
FIG. 3
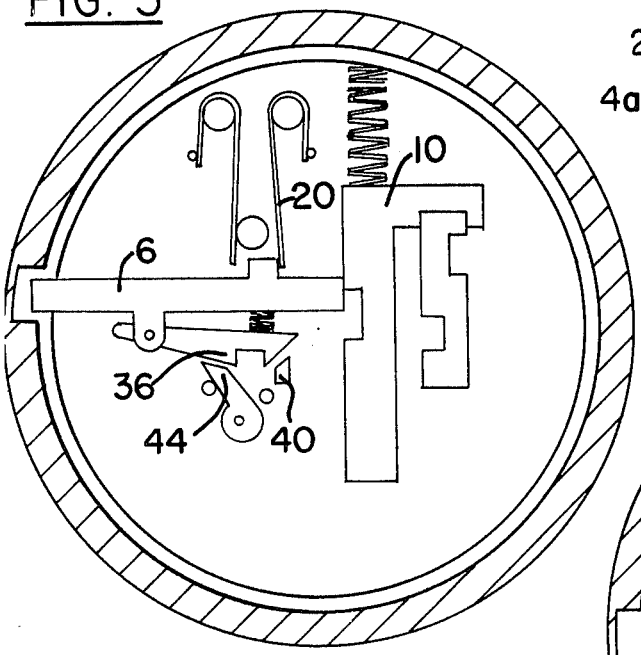
FIG. 4
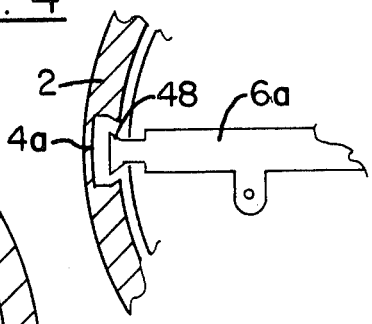
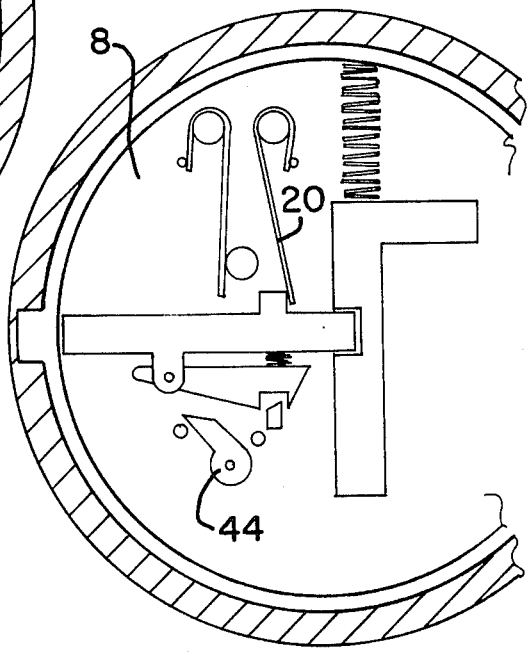
FIG. 5

IG. 10
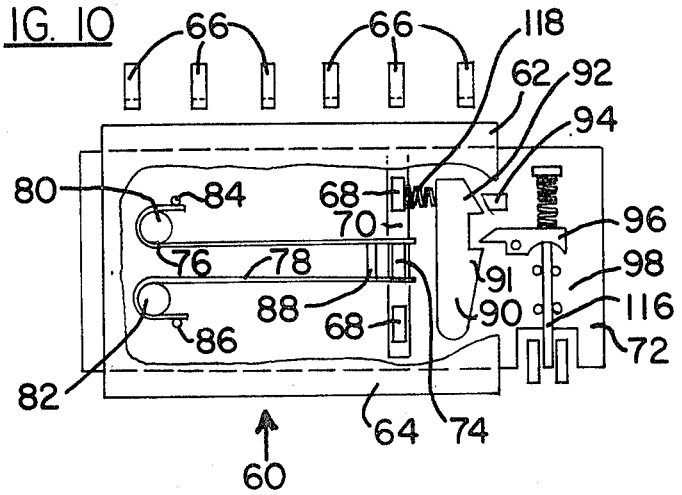
FIG. 11
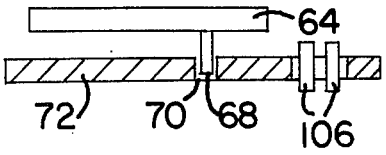
FIG. 12
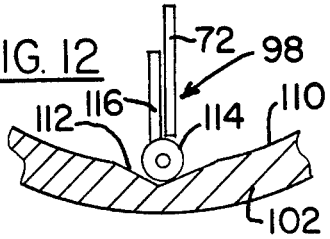
FIG. 13
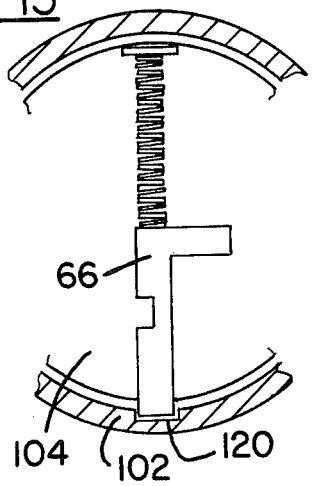
FIG. 14
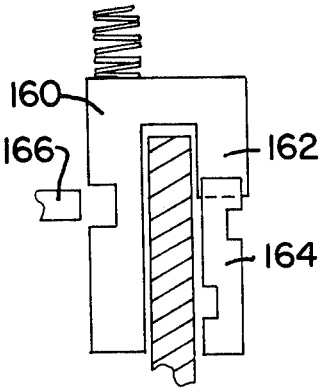
FIG. 15
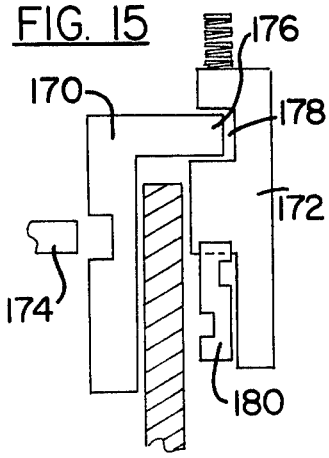
FIG. 16
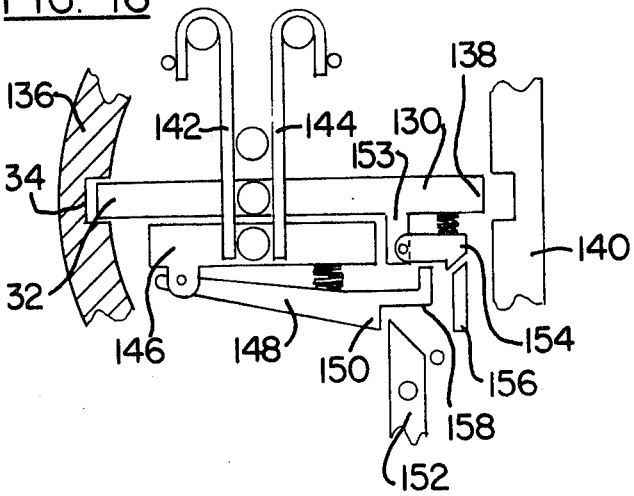

KEY LOCK WITH A FLYING SIDEBAR

BACKGROUND OF THE INVENTION

Locks that are operated by keys today fall into several general classes. The only locks worth discussing from the point of view of high security are those where the keys can have a great many variations so that simply supplying a large assortment of keys is not practicable. Such locks, in general, employ mechanisms where the key sets up a set of elements, usually called tumblers, that may be small cylinders, pins, flat washers, sectors, or complete circles, and where each of such tumblers can be set into one of a plurality of positions. It follows, therefore, that if a key can set six tumblers, each of which can have ten positions, the number of combinations can become one million. In practice, such large numbers are not easily reached because of practical constraints, but this is the general theory.

The manner inwhich such locks are generally picked is that a suitable tool or tools are inserted into the passage for the key, and each tumbler is manipulated while the lock mechanism is under some forced constraint. By feeling the motion of a tumbler, it is possible to determine its correct position or, in some cases, one of several possible correct positions.

In order to make such locks difficult to pick, various expedients are resorted to. Tumblers are provided with fake notches, special shapes are used to make them difficult to move, a large number of tumblers are provided by making the key more elaborate as, for example, by cutting the key on both edges and providing two sets of tumblers, or by making the key slot with four sets of tumblers mounted at right angles, etc. There is a class of locks popular at the present time where pin tumblers are not only raised to their proper position but also rotated slightly by the key with each tumbler provided with an opening in its side into which a special sidebar fits when they are all in the correct positions, both axially and in rotation.

To the best of my knowledge, all such locks can be picked except that in the case of the best of them, this is difficult and requires great skill and is time consuming. As described in my U.S. Pat. No. 4,111,019, I have designed and built models of locks which so far have defied the efforts of some of the outstanding lock experts. This lock uses two sets of opposing tumblers which are set by a thin flat key bent into a wavy shape. The lock provides no space for a straight pick or a pick of any other shape except that of the correct key, and no tool thicker than the key has any chance of opening the lock. The lock does have the disadvantage in that the keys are not of the standard type and cannot be duplicated by existing key-cutting equipment.

In U.S. Pat. No. 3,172,283 also issued to me, I describe a combination lock that is probably impossible to defeat without X-raying the mechanism or physically damaging the lock as, for example, by drilling.

This present invention describes a lock system that uses any ordinary type of key, but which is proof against all methods of surreptitious entry that are known to me. The lock has the advantage that conventional key making and duplicating equipment may be used and also that the usual key mastering techniques can be employed, if desired.

An excellent overall description that treats the whole subject of locks is the recently published report of the National Bureau of Standards entitled "High Security Locking Devices: A State-of-the-Art Report," No. NBSIR 81-2233, issued January 1982.

SUMMARY OF THE INVENTION

The lock of the present invention can use a conventional type of key cut or manufactured by conventional equipment. The principle of the lock is that a set of tumblers are set by the key in the conventional manner. The tumblers, for example, can be in the shape of pins, washers, or sectors. The tumblers coopeate with a sidebar, again in a fairly conventional manner. The sidebar, when not in cooperative arrangement with the tumblers keeps the lock from operating; for example, it keeps an inner cylinder from turning in an outer cylinder of a lock. For the lock to be opened, the sidebar must be moved into engagement with the tumblers and out of engagement with the stationary components of the lock. The difference between my lock and the prior art is that the sidebar is not movable into such engagement except by being propelled by its own inertia, against the action of a first spring that normally keeps it out of engagement and out of contact with the tumblers. The method of propulsion is such that when the key is inserted into the lock, some mechanism is used to push the sidebar still further away from the tumblers, against the action of another spring. The sidebar is then suddenly released and is propelled by this spring towards the tumblers. It passes its neutral or rest position and continues movement because of its own inertia, against the action of the first spring, and then engages the tumblers.

If the tumblers are correctly set, the sidebar either enters notches in the tumblers or cooperates in other ways so as to release the lock. It is caught in this position by a suitable latch that will be described subsequently. If the tumblers are not correctly set by the key, the sidebar impacts the incorrectly set tumblers and is immediately returned by the first spring back to its rest position. There is no external mechanism by which the sidebar can be pushed or held against the tumblers so that their proper position can be determined by a pick. Even if this could be done (and this will be discussed in detail later), the forces on the sidebar are such as to move it away from the tumblers because the sidebar has not yet been latched into the operating position.

BRIEF DESCRIPTION OF THE DRAWINGS

FIG. 1 is a transverse view of the schematic mechanism of the lock in its normal locked condition.

FIG. 2 is a transverse view of the lock as the release element of the lock is cocked when an attempt is made to open it without the tumblers being properly set with a key.

FIG. 3 is a transverse view of the invention in a later stage of operation where an attempt is made to open the lock without having properly set the tumblers with a key.

FIG. 4 is a modified form of an element of the invention.

FIG. 5 is a transverse view of the invention where the lock is in an unlocked state.

FIG. 10 is a plan view of a further modified form of the invention located in the lock as shown in FIG. 9.

FIG. 11 illustrates certain details of FIG. 10.

FIG. 12 illustrates additional details of FIG. 10.

FIG. 13 illustrates a further modified form of the invention.

FIG. 14 illustrates a modified form of the tumblers of the invention.

FIG. 15 illustrates certain optional details of the tumblers of the invention.

FIG. 16 illustrates a still further modified form of the invention.

DETAILED DESCRIPTION OF THE DRAWINGS

Figure 6:
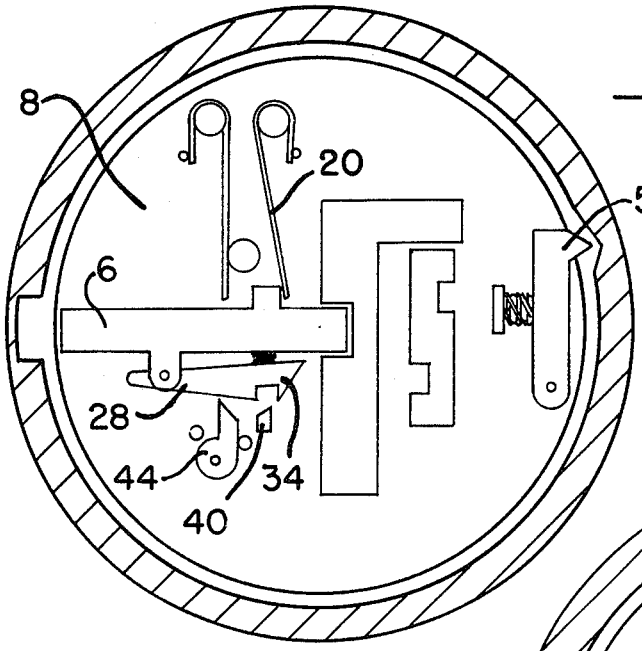
FIG. 6 is a transverse view of the invention in which the lock is in its unlocked state and the locking element has been released to restore the lock to its locked state.

In order to describe the operation of the lock, I prefer to show the principle by means of the schematic diagrams of FIGS. 1, 2, 3, 5, 6, 7 and 8. It should be understood that these drawings are not detailed working drawings, but rather show the main features of the lock without regard to actual physical constructions.

FIG. 1 shows the following elements: the outside ring 2 provided with a notch 4 for the sidebar 6; the inner cylinder 8 which carries all the working parts as follows: a set of tumblers only one of which is shown schematically by the flat tumber 10; and the co-acting spring 12; a key slot 14 through which a key passes and which, in turn, can move the tumbler 10 up and down. The sidebar 6 normally rests in the position shown in FIG. 1, held in this position by its protrusion 16 which, in turn, is held by two springs 18 and 20 mounted on two pins 22 and 24 and preloaded against pin 26. The spring 18 to the left is made to have a greater force on the projection 16 than the spring 20 on the right. The reason for this will be explained. The springs 18 and 20 are both preloaded against the pin 26 so as to hold the sidebar 6 firmly in the position shown. The sidebar 6 is further provided with a latch lever 28 pivoted at point 30 and located so as to be able to rotate through a small angle. It is held in the downward (clockwise) position by a spring 32 attached to the sidebar 6. The latch lever 28 has two downward projections 34 and 36. One, 34, on its right side, is designed to latch the sidebar 6 if it should enter the notch 38 in the tumbler 10. It does so by hooking behind a stationary projection 40 attached to the cylinder body 8. The other projection 36 can be acted on by a rotary trigger 44 which can be operated either by a separate external mechanism, such as a small knob fastened to shaft 46, or can be operated by merely turning the cylinder 8 through a small angle after the insertion of the key, as will be described later.

Imagine now that an incorrect key was inserted into the lock. The rotary trigger 44 is swung counter-clockwise, thus pushing the sidebar 6 to the left and further into the notch 4 in the stationary member 2 of the lock. As this trigger 44 is turned further counter-clockwise, this cocks the spring 18 into the position shown in FIG. 2. If the trigger 44 moves still further, it falls off the projection 36, the sidebar 6 is now propelled rapidly to the right, and because of its inertia passes its rest position (shown in FIG. 1), bends the spring 20 (as shown in FIG. 3) and impacts the incorrect tumbler 10 or other incorrectly set tumblers. It does not go far enough to the right to latch against the stationary member 40, and is returned rapidly to the left, both by the action of the spring 20 and by elastic re-bound off the tumblers.

If an attempt is made to catch and hold the sidebar 6 in the contact position by turning the inner cylinder 8 so that the right end of the sidebar 6 rubs against the side of the tumbler 10, some rubbing could be produced against one or more of the tumblers, except that all the forces on the sidebar 6 are to move it away from the tumblers 10, and even if one could feel the correct position of one of the tumblers in this manner, the lock could not be opened because there is no mechanism by which the bar 6 could be moved further to the right. As soon as any torque on the cylinder 8 is reduced, the bar 6 would fly back. Such an attempt is very difficult to perform. If torque is applied to the cylinder 8 before the sidebar action is initiated, the sidebar 6 will not "fly" freely to the right and will not reach the tumblers 10 at all. Moreover, as I said earlier, to prevent even this type of operation, the back (left) end 48 (FIG. 4) of the sidebar 6*a* can have a mushroom shape as shown in FIG. 4 and the stationary notch 4*a* in member 2 can have the shape as shown in FIG. 4 so that any attempt to press the sidebar 6*a* against the sides of the notch 4*a* can cause a jamming action of the two surfaces so as to keep the sidebar 6*a* to the left and out of contact with the tumblers. If the sidebar 6*a* were projected rapidly to the right in normal operation, these surfaces would not come into contact.

Assume now that a correct key has been inserted into the lock. The tumblers 10 have been correctly lined up so that their notches 38 are in the position shown in FIG. 1. Again, the trigger 44 is swung counter-clockwise. The sidebar 6 is moved to the left as shown in FIG. 2, except that the notches of the tumblers are now as shown in FIG. 1. Turning the rotary trigger 44 further releases the sidebar 6 and it again flies to the right. This time it enters the notches 38 and is locked in this position by the hook 34 acting with the fixed member 40. The spring 20 remains cocked as shown in FIG. 5. The lock is now open and the cylinder 8 can be turned.

When the cylinder 8 is returned to its original position, and it is desired to withdraw the key, the trigger 44 is turned clockwise. This causes its pointed end to lift the latch bar 28 as shown in FIG. 6. This lifts the hook 34 off the catch member 40. The sidebar 6 is propelled to the left by spring 20 and returns to its rest position as shown in FIG. 1. The key can now be withdrawn because all of the tumblers are free to move up or down.

Figure 7:
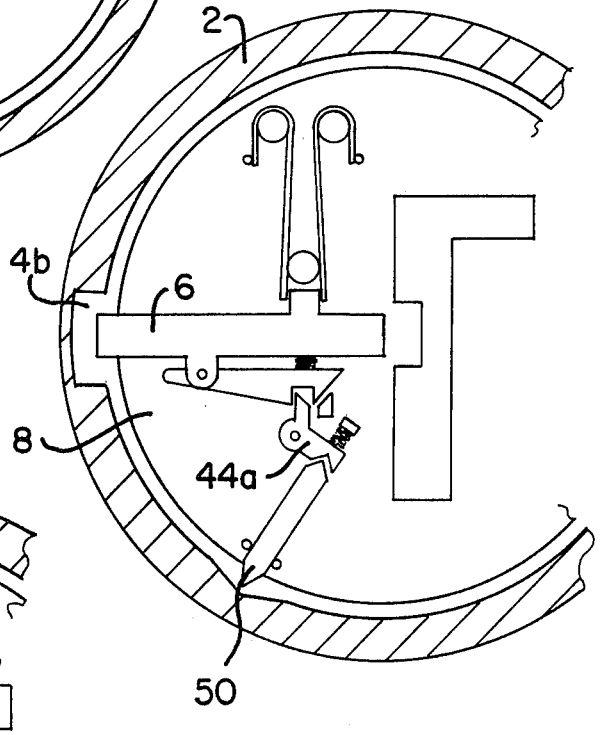
FIG. 7 is a transverse view of a modified form of the invention in which the lock is in its locked state.

While so far I have described the means to move the trigger 44 by separate manual means, another way of moving the trigger lever 44*a* is to connect it to a radially movable detent device 50 as shown in FIG. 7 so that the mere initial rotation of the cylinder 8 would produce the necessary cocking action of sidebar 6. For this purpose, the notch 4*b* in the stationary ring 2 is made wide enough so that a limited rotation of the inner cylinder 8 is permitted, before the sidebar 6 contacts either side of this notch 4*b*.

If the operating mechanism is operated either by the insertion motion of a key or by an external knob or by an external push-button that is used to operate the trigger 44, this partial freedom of rotation of the cylinder 8 is not necessary, and a simple detent 52 can be used to help improve the "feel" of the lock by indicating the normal rest position where the lock is latched and the key can be withdrawn. Such a simple latch 52 is shown in FIG. 6.

Figure 8:
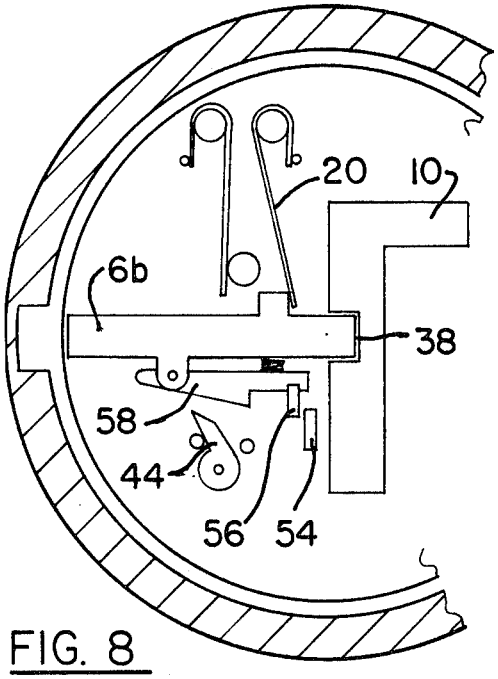
FIG. 8 is a transverse view of a modified form of the invention in which the lock is in its unlocked state.

A slightly different version of this lock is shown in FIG. 8. Here the latch 58 for the righthand position of the sidebar 6*b* is not a mechanical hook but a magnet 54 which cooperates with a ferrous plate 56 attached to the latch 58 of the sidebar *6b* assembly. The magnet 54 is located in such a way that when the sidebar *6b* enters the notches 38 of the correctly set tumblers 10, the metal plate 56 touches the magnet 54 and is held in that position. The mechanism shown in FIG. 6 may be used to release the latch 58. The metal plate 56 that contacts the magnet 54 is attached to the movable latch member 58 and can be moved vertically by the trigger lever 44 in the manner similar to that of the latch 28 of FIG. 6 so that the metal plate 56 is disengaged from the magnet 54 and the sidebar *6b* can be moved to the left by action of spring 20.

I will now describe a possible construction of my invention for an actual lock that may use the features that were described in the schematic drawings 1 thru 8.

Figure 9:
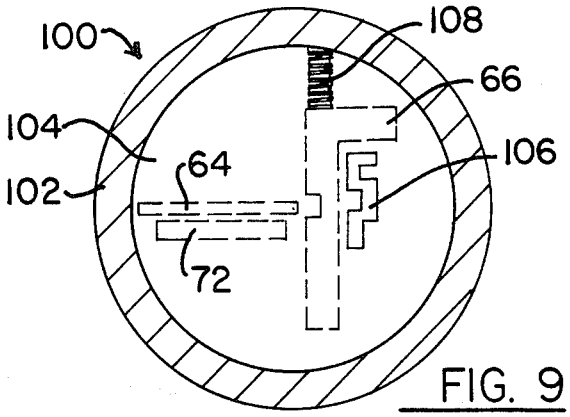
FIG. 9 is a transverse view of certain modified details of construction of the lock.

Please now consider FIG. 9. The lock 100 consists of a cylindrical fixed body 102 in which rotates the working cylinder 104. The working cylinder 104 is provided with a key slot 106 of the usual shape. The key (not shown) operates a set of tumblers 66, set in slots in the inner cylinder 104. The tumblers 66 have springs 108 to push the tumblers 66 into contact with the key. The details need not be described here since they are common in millions of locks today.

Now please consider FIG. 10. Suitably mounted into the inner cylinder 104 of FIG. 9 is a sidebar mechanism 60 employing my invention. The edge 62 of the sidebar 64 is just outside of the tumblers 66 and does not contact them. The sidebar 64 is made to move parallel to itself by a projection 68 which rides in a slot 70 in the member 72 attached to the inner cylinder 104 of the lock 100, as shown in FIGS. 10 and 11.

For simplicity of explanation, I shall describe the sidebar mechanism 60 as it might be made separate from the inner cylinder 104 of the lock 100. It can be then inserted into a suitable space in the inner cylinder 104 and fastened to it.

In FIGS. 1 to 8, I showed simplified drawings of my invention as if they were taken at right angles to the axis of a conventional cylinder of a typical Yale type lock. If one assumes that the overall diameter of such a cylinder lock is of the order of one inch, then the space needed for the mechanisms shown is rather small. In order to provide more space for the necessary components I show, in FIGS. 10, 11, and 12, a design which can be arranged parallel to the central axis of a typical cylinder lock such as shown in FIG. 9. The mechanism 60 consists basically of a fixed plate 72 and a movable side bar 64. The fixed plate 72 is attached to the rotating cylinder 104 of the lock by any suitable means, while the movable plate 64 is the sidebar that cooperates with the tumblers 66.

Acting on a section 74 of the sidebar projection 68 are two springs 76 and 78 mounted on the plate 72. They are located parallel to the sidebar 64 and just below it. The pins 80 and 82 on which they are mounted and pins 84 and 86 which control their tension are mounted on the plate 72. A projection 88 holds them in their correct preloaded position, as did pin 26 in FIG. 1 described earlier, and they operate on the projection 74 that is part of the sidebar 64.

Pivoted to the sidebar 64 and located between it and plate 72 is a latch member 90 having two projections, 91 and 92. One, 92, is the latching hook that cooperates with the fixed projection 94 mounted on the plate 72. It locks the sidebar 64 if it enters the tumblers 66. A small compression spring 118 acts to rotate the latch member 90 clockwise. The projection 91 on the latch 90 cooperates with the trigger lever 96 pivoted on the plate 72. A detent mechanism 98 cooperates with this trigger lever 96 as follows: Cut into the inner surface 110 of the fixed case 102 of the lock is a notch depression 112 shown in section of FIG. 12. Co-acting with the depression 112 are two small wheels 114 at the end of the detent bar 116. This detent bar 116 cooperates with the trigger lever 96. When the wheels 114 are in a detented position, that is in the notch 112, the lever 96 is shown as in FIG. 10. If the inner cylinder 104 is turned slightly, the detent member 98 will be moved upward (in FIGS. 10 and 12) and the trigger lever 96 will be rotated counter-clockwise. In doing so, it will move the sidebar 64 away from the tumblers 66, as was described earlier by means of the schematic diagrams. As lever 96 continues to turn counter-clockwise, the sidebar 64 will be relased to fly upward, and will either be stopped by incorrectly set tumblers 66 and returned to its rest position or, if the tumblers 66 are correctly set, it will enter them and be latched so that the cylinder 104 can continue its rotation.

When the cylinder 104 returns to its normal rest position, the wheel 114 of detent 98 will re-enter the depression 112, causing lever member 96 to rotate clockwise, thus moving the latch 90 to the left (FIG. 10) and releasing the hook 92 from member 94 against the action of spring 118. Spring 76 will then return the sidebar 62 to its rest position and the lock will now be locked again, the tumblers 66 will be free to move and the key can be withdrawn.

It will be noted that with this construction, it is possible to move the inner cylinder 104 (FIG. 9) slightly clockwise or counter-clockwise, thus operating the trigger 96 but not opening the lock. In order to prevent this type of operation which may cause wear and that serves no purpose, I can make the tumblers 66, normally in their rest position, project beyond the outer circumference of the inner cylinder 104 and engage the shallow groove 120 of the outer cylinder 102 as shown in section view of FIG. 13. Any key or any suitable tool can then be used to lift all the tumblers and to effect a small rotation of the cylinder. This will not jeopardize the security of the lock, but will make the lock feel more definite in its rest position and will reduce the possibility of random tampering with the latch mechanism.

It should be obvious that the construction mechanism of this lock can be modified in many fundamental ways. For example, the tumblers can be made of cylindrical shape with circular grooves cut in them, or they can have holes drilled so that they can be both lifted and rotated into their proper position and the sidebar can have projecting pins to enter such holes in the tumblers. The tumblers can also be made as sectors, and instead of a sidebar of the shape shown, the sectors can have internal notches in their internal construction, the sidebar being a bar passing through all the sectors. It can enter or not enter the notches by being "thrown" against them. It should be understood that the principle that is important in my lock is that the element which I call the sidebar could be made to move in many ways, for example, in an arc. It can be made in the shape of a bar, a plate, a section of a cylinder, etc., as long as it does not touch the elements controlled by the key. This member in whatever shape, can only be moved away from contact with the tumblers by the lock mechanism accessible to the outside world. It is then propelled against the tumblers and is moved by its own inertia to cooperate with the tumblers to release the lock.

It should also be understood that the inertia member may be separate from the "flying" bar member, and can be physically separate from it except that it would be thrown in the manner described and then it could impact the locking bar and project it against the tumblers. The principle would still remain the same. No outside mechanism should reach this propulsion system except to cock it. An example of a scheme where the sidebar is propelled by a separate inertia member can be seen in FIG. 16. Here I show a sidebar 130, the left end 132 of which engages a notch 134 in the stationary member 136 of the lock. The right end 138 of the sidebar 130 is held out of contact with the tumblers 140 by the action of two opposing springs 142 and 144 in a manner similar to the designs of FIGS. 1, 7 and 10. A second member 146 is located in close proximity to the sidebar 130. It is also held in a fixed position by the same two springs 142 and 144. This second member 146 is equipped with a bar 148. This bar has a projection 150 by means of which a trigger 152 can be employed to move this member 146 to the left (in FIG. 16). When the trigger 152 falls off the projection 150, the member 146 is propelled rapidly to the right and impacts the projection 154 of the sidebar 130. This propells the sidebar 130 to the right. Depending on the relative masses of the member 146 and the sidebar 130, the member 146 may stop completely or continue movement to the right. Its motion is of little importance after the impact.

The sidebar 130 will now either enter the notches in the tumblers 140, if they were set by the correct key, or impact one or more incorrect tumblers and return to its rest position. If it enters the notches, its latch 154 will catch on the fixed piece 156 and it will stay in this position so that the lock can be opened.

When the trigger 152 is turned clockwise back to its normal position, it will lift the bar 148. This bar has a projection 158 that cooperates with the latch 154 so as to lift it and release it from the fixed piece 156. The sidebar 130 and the inertia member 146 will now return to their rest position as shown in FIG. 16.

It should be noted that while this two-component mechanism (of FIG. 16) is more complicated than the ones shown in prior described embodiments, it does have the advantage that the notch 134 in the fixed component 136 of the lock need not be made deeper than that required for the sidebar 130 to occupy in its normal, rest position.

In any case, I wanted to demonstrate what I meant by the statement that the sidebar can be propelled by a separate inertia member.

It is apparent that when a sidebar impacts against an improperly set tumbler, this tumbler experiences a small shock. In a simple configuration of the lock as, for example, of FIG. 1, it may be possible to feel this shock by means of a suitable tool inserted into the key slot. It may then be possible to move the tumbler up and down and determine the position at which the sidebar no longer hits this tumbler. This would provide a clue as to the proper shape of the key at this point.

The procedure could be repeated for all of the tumblers. In order to guard against this attack, which admittedly is very difficult and time consuming, I provide two additional safety features in the design of the tumblers, as shown in FIGS. 14 and 15.

FIG. 14 shows one of the tumblers 160 so shaped that only the portion 162 is reachable through the key slot 164. This portion 162 of the tumbler 160 is, of course, the element that is operated upon by the key. A sideways motion of the tumbler, as when hit by the sidebar 166, would be very difficult to detect.

A still more sophisticated design of each tumbler is shown in FIG. 15. Here the tumbler is made of two parts. One part 172 is raised and/or lowered by the key, while the other part 170 co-acts with the sidebar 174. The two parts are fitted to each other by a tongue-and-groove arrangement as shown at 176 and 178. The fit is such that the parts are free to slide sideways relative to each other, but are locked together to move up and down when acted upon by a key. Thus, one can feel the key sensing component 172 through the key slot 180 but the acting portion 170 of the tumbler is isolated from the key slot 180.

It is also obvious that such locks could be drilled or destroyed by means usually employed for such purposes and the protection against this would be no different from that of the prior art. This would require hardened inserts, special covers, and systems for jamming devices so that if certain types of forces are employed the lock would be made to jam. None of such protections against physical attacks should be considered a part of this patent application.

I claim to have invented:

1. In a lock to be operated by a key; a plurality of key-settable elements operable by the key to move into selected positions respectively to enable the lock to be unlocked; a movable element, physically spaced from said key-settable elements when the lock is in a locked state, operable to hold the lock in a locked state; said movable element having such inertia and bias that when it is moved in a given direction and released it will move into engagement with said key-settable elements and if the key has set those key-settable elements into said selected positions the movable element will move to a location which places the lock in an unlocked state; said lock including enabling means for moving said movable element, after the key has set said key-settable elements in said selected positions, in said given direction and then releasing the movable element so it will move into engagement with said key-settable elements; said key-settable elements including means which when said key-settable elements are in said selected positions the movable element may move to said location and thus place the lock in an unlocked state; said given direction being a direction away from said key-settable elements.

2. In a lock as defined in claim 1, said movable element having such inertia and bias that when it is moved in said given direction and released it will move into engagement with said key-settable elements by its own inertia.

3. In a lock as defined in claim 1, each of said key-settable elements having an indent; said indents being alined to receive said movable element when set by a key which is correct for the opening of the lock.

4. In a lock as defined in claim 3, holding means for holding the movable element in said indents once that element enters said indents.

5. In a lock to be operated by key; a plurality of key-settable elements operable by the key to move into selected positions respectively to enable the lock to be unlocked; a movable element, physically spaced from said key-settable elements when the lock is in a locked state, operable to hold the lock in a locked state; said movable element having such inertia and bias that when it is moved in a given direction and released it will move into engagement with said key-settable elements and if the key has set those key-settable elements into said selected positions the movable element will move to a location which places the lock in an unlocked state; said lock including enabling means for moving said movable element, after the key has set said key-settable elements in said selected positions, in said given direction and then releasing the movable element so it will move into engagement with said key-settable elements; said key-settable elements including means which when said key-settable elements are in said selected positions the movable element may move to said location and thus place the lock in an unlocked state; said lock having a cylinder, said key-settable elements and said movable element comprising at least part of said cylinder, and stationary means engagable by said movable element, when the lock is in its locked state, to thus hold the cylinder in fixed relation to the stationary means; said enabling means comprising a cam surface on said stationary means and cam means on said cylinder, for moving the movable element in said given direction.

6. In a lock as defined in claim 1, said movable element including spring means providing said bias to hold said movable element physically spaced from said key-settable elements.

7. In a lock as defined in claim 1, said lock having a cylinder, said key-settable elements and said movable element comprising at least a part of said cylinder, and stationary means engagable by said movable element, when the lock is in its locked state, to thus hold the cylinder in fixed relation to the stationary means.

8. In a lock as defined in claim 7, said enabling means comprising a cam surface on said stationary means, and cam means on said cylinder, for moving the movable element in said given direction as the cylinder turns.

9. In a lock to be operated by a key; a plurality of key-settable elements operable by the key to move into selected positions respectively to enable the lock to be unlocked; a movable element, physically spaced from said key-settable elements when the lock is in a locked state, operable to hold the lock in a locked state; said movable element having such inertia and bias that when it is moved in a given direction and released it will move into engagement with said key-settable elements and if the key has set those key-settable elements into said selected positions the movable element will move to a location which places the lock in an unlocked state; said lock including enabling means for moving said movable element, after the key has set said key-settable elements in said selected positions, in said given direction and then releasing the movable element so it will move into engagement with said key-settable elements; said key-settable elements including means which when said key-settable elements are in said selected positions the movable element may move to said location and thus place the lock in an unlocked state; said movable element having a ledge, said enabling means comprising a latching element that engages the ledge and moves the movable element in said given direction until said latching element moves off the ledge at which time the movable element is released.

10. In a lock as defined in claim 9, having a cylinder comprising said movable element and said key-settable elements, in which said latching element is driven, to move the movable element in said given direction, when said cylinder rotates in at least one direction.

11. In a lock as defined in claim 1, holding means for holding the movable elements in said engagement when the lock is in the unlocked state, means for releasing said movable element from said engagement and move said movable element to place the lock in its locked state.

12. In a lock as defined in claim 2, spring means providing said bias to hold said movable element physically spaced from said key-settable elements, and spring means to propel the said movable element toward the said key-settable elements after the movable element has been released by said enabling means.

* * * * *